United States Patent [19]

Imler et al.

[11] 4,153,083

[45] May 8, 1979

[54] PROCESS AND ARRANGEMENT FOR FILLING GAS CYLINDERS

[76] Inventors: Jacques Imler, CH-3034 Murzelen, Canton of Bern; Karel Masek, Landorfstrasse 40, CH-3098 Koeniz, Canton of Bern, both of Switzerland

[21] Appl. No.: 852,599

[22] Filed: Nov. 11, 1977

Related U.S. Application Data

[63] Continuation of Ser. No. 657,408, Feb. 12, 1976, abandoned, which is a continuation-in-part of Ser. No. 477,495, Jun. 7, 1974, abandoned, which is a continuation-in-part of Ser. No. 315,164, Dec. 14, 1972, abandoned.

[30] Foreign Application Priority Data

Dec. 15, 1971 [CH] Switzerland ..... 18259/71

[51] Int. Cl.[2] ..... B65B 31/00

[52] U.S. Cl. ..... 141/4; 141/39; 141/237

[58] Field of Search ..... 138/40, 41; 141/1, 2, 141/4, 37, 39, 3, 11, 18, 46, 69, 70, 192, 237, 382, 392; 252/1

[56] References Cited

U.S. PATENT DOCUMENTS 1,443,550 1/1923 Wilkinson ..... 141/4 X

*Primary Examiner*—Richard E. Aegerter
*Assistant Examiner*—Frederick R. Schmidt
*Attorney, Agent, or Firm*—Michael J. Striker

[57] ABSTRACT

Gas to be stored flows along a gas feed line and into a cylinder containing a solvent for the gas. During its passage along the gas feed line, the gas flows through a dosing device which, on the one hand, permits a substantially adiabatic expansion and concomitant cooling of the gas to occur and, on the other hand, automatically regulates the flow rate of the gas in dependence upon the pressure difference across the dosing device. The pressure upstream of the dosing device is maintained constant regardless of the pressure downstream thereof, which latter pressure is variable due to the fact that dissolution of the gas generates heat and an accompanying increase in the pressure inside the cylinder. The constant pressure upstream of the dosing device is slightly higher than the final pressure inside the cylinder when the latter has been filled. When the flow rate of gas into the cylinder is rapid so that large quantities of heat are generated, the pressure inside the cylinder rises so that the pressure differential across the dosing device decreases and the flow rate of the gas into the cylinder decreases. Conversely, when the flow rate of the gas into the cylinder is lowered, the heat generated by the dissolution can dissipate, the pressure inside the cylinder can decrease and the flow rate of the gas into the cylinder can increase. In this manner, the flow rate of the gas into the cylinder can always be adjusted to the absorption capacity of the solvent which decreases with increasing temperature and vice versa. Moreover, when the capacity of the cylinder is reached, the pressure inside it reaches its upper limit and the flow of gas into the cylinder automatically terminates thereby providing a high degree of safety.

15 Claims, 7 Drawing Figures

PROCESS AND ARRANGEMENT FOR FILLING GAS CYLINDERS

CROSS-REFERENCE TO RELATED APPLICATIONS

The present case is a continuation of application Ser. No. 657,408 filed Feb. 12, 1976 and since abandoned, which in turn was a continuation-in-part of application Ser. No. 477,495 filed June 7, 1974 and since abandoned, which in turn was a continuation-in-part of application Ser. No. 315,164 filed Dec. 14, 1972 and since abandoned.

BACKGROUND OF THE INVENTION

The invention relates generally to the confinement of gases and, more particularly, to the filling of gas cylinders. Of special interest is the filling of gas cylinders which contain a solvent for the gas to be stored and store the gas in at least partially dissolved state.

In the known methods of filling gas cylinders, a specified number of cylinders to be filled are connected to a gas distribution network. Once the cylinders have been connected, gas to be stored is conveyed along the gas feed line to the distribution network by means of a compressor or compressor group. For cylinders of the type which store gas in at least partially dissolved state, a solvent is provided in each cylinder prior to the filling process. During the dissolution process of the gas in the individual cylinders, a quantity of heat is generated which is proportional to the rate of dissolution. This heat causes an increase in the temperature of the solvent, particularly at the solvent-gas interface, and, as a result, the dissolution process, which is substantially temperature dependent and the rate of which decreases with increasing temperature, is slowed. Thus, the time required for filling a cylinder is lengthened.

Moreover, in analogy with the methods used for filling cylinders with compressed gas, the gas pressure in the distribution network is generally increased gradually from an initial value to a final value without taking into account the temperature of the cylinder so that it is possible for the cylinder to become overcharged due to the above-outlined effect. If, because of the above-outlined effect, the cylinder becomes overcharged, that is, the capacity of the cylinder is exceeded, it is possible for the temperature and the pressure in the cylinder to exceed the permissible engineering safety limits which may lead to disastrous consequences.

Attempts have been made to overcome the foregoing disadvantages. Thus, it is known to cool cylinders with ambient air in order to remove the heat generated by the dissolution process and thereby increase the rate of the dissolution process and, concomitantly, reduce the time required for filling the cylinders. However, this has not been satisfactory. Later attempts which have been used in practice to increase the rate of the dissolution process and decrease the filling time have been primarily directed to more rapid removal of the heat generated by the dissolution process than can be realized with air-cooling. These attempts have involved subjecting the cylinders to more intensive cooling such as, for instance, the utilization of cooling water, fluid colloidal systems and freezing mixtures to convey heat from the exterior surfaces of the cylinders. None of these attempts have, however, led to satisfactory results.

The conventional manner of filling cylinders of the type under discussion, that is, connecting a large number of cylinders with a gas feed line and increasing the line pressure during the filling operation until the cylinders are completely filled, possesses another disadvantage aside from the safety factors involved and the fact that the filling time is dependent upon the absorption time, which latter is quite long. This resides in the fact that it is not possible to connect an empty cylinder to the gas feed line while the filling operation is in progress. This has adverse economic implications by virtue of the time lost when a cylinder is ready to be filled but cannot be connected to the gas feed line and by virtue of the lost, non-productive space occupied by the empty cylinder while waiting to be filled.

In general, it has been found that the economy and safety of conventional filling plants can be improved.

SUMMARY OF THE INVENTION

It is, therefore, a general object of the invention to provide a novel method and arrangement for the confinement of gases or the filling of gas cylinders.

More particularly, it is an object of the invention to provide a novel method and arrangement for the confinement of gases which are stored or confined in an at least partially dissolved state.

Another object of the invention is to provide a method and arrangement for the confinement of gases in an at least partially dissolved state whereby gases may be confined more economically than has been possible heretofore.

A further object of the invention is to provide a method and arrangement for the confinement of gases in an at least partially dissolved state whereby gases may be confined with a much higher degree of safety than was possible unil now.

An additional object of the invention is to provide a method and arrangement for the confinement of gases in an at least partially dissolved state which may be used in presently existing filling plants without requiring substantial investments for modification of the latter.

A more specific object of the invention is, for the filling of gas containers which contain a solvent, to achieve a substantial increase in the rate of dissolution through the production of optimum pressure and temperature characteristics in the gas feed line or gas distribution line and in the gas volume above the surface of the solvent while, simultaneously, maintaining a high degree protection and security against the danger of explosions.

A concomitant object of the invention is to provide a device which permits optimum pressure and temperature characteristics to be continuously maintained in the gas feed line or gas distribution line as well as in the gas volume above the surface of the solvent.

In pursuance of the foregoing objects, and of others which will become apparent, the invention provides a method of confining gases wherein a gaseous substance is conveyed along a predetermined path. The gaseous substance is admitted into a confining space located adjacent a downstream end of the path and which is adapted to contain a predetermined quantity of the gaseous substance at a predetermined pressure and temperature. A substantially constant pressure, which is equal to at least this predetermined pressure at the temperature interiorly of the confining space, is maintained in at least one portion of the path upstream of the confining space.

Thus, according to one feature of the method in accordance with the invention, a practically constant pressure is maintained in at least one portion of the gas feed line or gas distribution line. The confining space may, for instance, be a gas cylinder containing a solvent for the gaseous substance. In this event, there will be a liquid space and a gas space inside the cylinder defining with one another a liquid-gas interface. According to the invention, regulatory pressure and temperature characteristics for the dissolution process and its safety are created in the cylinder on the side of the gas phase therein, that is, above the liquid-gas interface, which characteristics, for the entire duration of the filling operation, permit optimum utilization of the dynamic absorption capacity or receptivity of the solvent for the gaseous substance to be achieved. This is accomplished by self-dosing or self-regulation of the gas supply from the gas distribution network. The dynamic absorption capacity of the solvent for the gaseous substance is determined, in part, by the capacity of the cylinder and the characteristics thereof. The latter include the geometric shape of the cylinder and the volume of the cylinder. The dynamic absorption capacity of the solvent also depends upon whether or not the cylinder contains a porous mass which is soaked with the solvent, the kind of porous mass (if provided), the type of solvent used and the quality of solvent present. Moreover, the absorption capacity or ability of the solvent at any instant will depend upon the concentration, at that instant, of the solution formed by dissolution of the gaseous substance and upon the temperature of the solution.

The invention further provides an arrangement for confining gases which includes means defining a flow path for a gaseous substance and for providing communication between a downstream end part of the path and the interior of at least one container to be filled with the gaseous substance to a predetermined pressure. Means is also provided for conveying the gaseous substance along the flow path and for maintaining, in at least one portion of the flow path upstream of the end part thereof, a substantially constant pressure which is equal to at least the predetermined pressure to which the container is to be filled. Downstream of this portion of the flow path and in the flow path, there is provided means having an upstream side and a downstream side and being operative for regulating the flow rate of the gaseous substance in dependence upon the pressure differential between these upstream and downstream sides.

The arrangement in accordance with the invention is particularly well-suited for carrying out the process of the invention. The container to be filled with the gaseous substance may be a gas cylinder, for example. For the connection of one or more cylinders or cylinder groups to be filled, a gas distribution network or line having a practically constant pressure maintained therein is provided. In the conduit leading to each cylinder or cylinder group, a regulating or dosing device is provided which permits the flowing gaseous substance to pass therethrough in quantities depending upon the pressure difference before and after the device.

It will be appreciated that the present invention has provided a system for the fast, safe and continuous filling of cylinders for dissolved gas. Gas is available in the gas feed line of the filling station at a substantially constant pressure which is at least equal to the filling pressure, that is, the pressure interiorly of the cylinder when it has been charged to capacity. The substantially constant pressure in the gas feed line is preferably greater than the filling pressure and, advantageously, is slightly, e.g. 0.5 to 1 atmospheres, higher than the pressure at the end of the filling. Due to the pressure differential thus created, gas flows into the cylinders connected to the gas feed line and expands thereby.

Generally, the quantity of gas flowing into the cylinders will not only depend upon the difference in pressure between the gas feed line and the gas space or volume inside each connected cylinder but will also depend upon the size and type of free passage or flow cross-section for the gas flow into the cylinders. Thus, the invention provides a novel regulating or dosing device which is mounted in the gas feed line or between the gas feed line and the connected cylinders. The dosing device has a definite and, advantageously, substantially constant, flow or passage cross-section for the flow and expansion of the gas and is designed so as to permit a substantially adiabatic expansion of the gas. Such an adiabatic expansion results in cooling of the gas so that the gas is, in effect, cooling itself. The thus-cooled gas is then conveyed to the surface of the solvent in each cylinder, that is, to the solvent-gas interface, bringing its cooling effect with it. Therefore, the temperature at which dissolution occurs is lowered and the dissolution process proceeds more rapidly than was possible heretofore, the reason for the more rapid dissolution being that the rate of dissolution generally increases with decreasing temperature. As a consequence, a considerable reduction in the filling time is realized from that obtainable with the prior art.

Furthermore, the instantaneous absorption ability of the solvent in each cylinder to be filled depends to a great extent upon the pressure and temperature inside the respective cylinder. Since heat is released during absorption of the gas, the temperature increases with increasing quantities of gas being absorbed. If the temperature inside the cylinders increases to too great an extent, the gas absorption ability of the solvent diminishes and, resultantly, the gas pressure inside the cylinders increases. Consequently, the difference in pressure between the gas feed line and the gas space is reduced thereby decreasing the flow of gas into the cylinders. This automatic effect guarantees a higher degree of safety than is obtainable with the prior art.

A similar effect occurs at the end of the filling period. Thus, when the absorption ability of the solvent is almost exhausted, the gas pressure in the cylinders increases and the gas flow is successively reduced and, finally, terminated automatically.

It will be apparent that, because a definite quantity of gas, which is dependent upon the pressure inside the cylinder, becomes expanded in and cools itself in the dosing device according to the invention, the filling time is short. In addition, a very high degree of safety is guaranteed in filling stations for cylinders or cylinder groups which store gas in an at least partially dissolved state when using the invention. Thus, the gas flow to each cylinder or cylinder group is automatically adapted to its instantaneous absorption ability, which latter depends upon the pressure and the temperature inside the cylinder at a given time. Moreover, an even greater degree of safety may be obtained in accordance with the invention by virtue of the fact that the gas flow in the dosing device may be laminar. In this connection, it should be mentioned that, for certain gases such as, for example, acetylene, the degree of safety is higher with laminar flow than with turbulent flow. Furthermore, by utilizing the system according to the invention, it is possible to connect empty cylinders or cylinder groups to the gas feed line at any time since it may be guaranteed that the line pressure will remain substantially constant while the gas flow from the gas feed line to the cylinders will accomodate itself to the total gas consumption of all cylinders connected to the gas feed line and being filled at that time. The pressure in a cylinder or cylinder group, which depends in part upon the temperature and concentration of the solution in the respective cylinder or cylinder group and also depends upon the characteristics of the cylinders, doses the gas flow from the gas feed line to the respective cylinder in such a manner that, at any time, the gas flow corresponds to the absorption ability of the solvent or solution and, further, such that each difference between the quantity of gas flowing into a cylinder and dissolving in the solvent has a compensating effect on the gas flow.

The dosing device according to the invention, which may be mounted in the line between the gas feed line and the cylinder or cylinder group to be filled, not only may assure an expansion and self-cooling of the gas but makes it virtually impossible for the gas to flow backwards through the dosing device. This dosing device may comprise an orifice plate, a capillary device, a nozzle, a valve or a sintered metallic body.

It will be appreciated from the preceding outline of the invention that the invention has provided a method, an arrangement and a device for the rapid and safe filling of cylinders with gas which is to be stored in an at least partially dissolved state whereby each cylinder or cylinder group to be filled with gas may be connected to the gas feed line at any time during the filling of other cylinders, that is, without interrupting the filling process of such other cylinders.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The invention is primarily, although not necessarily exclusively, concerned with a method, arrangement and device for filling gas from a gas distribution network or line into gas containers or cylinders which contain a solvent. Of articular interest is the filling of acetylene into so-called "dissolved acethylene cylinders" which contain the liquid solvent such as, for example, acetone or DMF (N,N-dimethylformamide), and a porous filler mass. However, it is to be expressly understood that this is in no manner intended to limit the invention to such an application only. The invention is applicable to the confinement of any and all gaseous substances which are to be stored or confined in an at least partially dissolved state regardless of the solvent used and whether or not a filler mass or porous filler mass is present.

Figure 1:
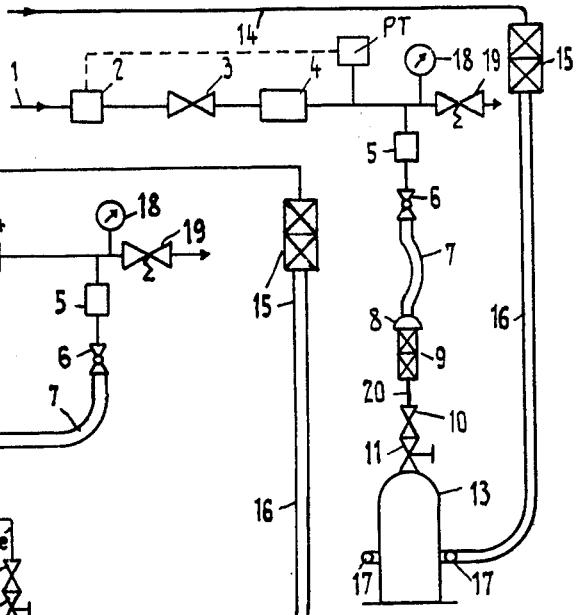
FIG. 1 is a somewhat diagrammatic representation of one form of an arrangement according to the invention which may be used for carrying out the method in accordance with the invention.

Referring now to FIG. 1, a gaseous substance or gas to be confined flows along a gas feed line or conduit 1 and, by means of a compressor 2, is conveyed through a high-pressure valve 3. It should be mentioned here that the conduit 1 may form part of a gas distribution network and, further, that a group of compressors may be provided instead of the single compressor 2 shown. From the valve 3, the gas flows through a first flashback arrester 4, a second flashback arrester 5 and then, via a ball valve 6, into a flexible gas hose 7. The gas is further conveyed through a regulating or dosing device 8, where it may undergo an expansion, and then through a connection 9 into a conduit or line 20. From the latter, the gas enters a cylinder 13 via a non-return valve 10 and a cylinder valve 11. The valve 11 is provided on the cylinder 13 for opening and closing the same. The cylinder 13 contains a solvent for the gas and, hence, dissolution of the gas occurs in the cylinder 13 with a concomitant generation or release of heat.

In order to facilitate the dissipation of heat from the cylinder 13, the latter is cooled. This is accomplished, for instance, by means of cooling water. The cooling water flows through a conduit 14 and a connection 15 into a flexible water hose 16. From the hose 16, the cooling water flows to the nozzles 17 adjacent the cylinder 13 and effects cooling of the latter.

A pressure gage 18 comunicates with the conduit 1 so as to permit a determination of the gas pressure therein. For safety reasons, a safety valve 19 is provided and communicates with the conduit 1.

In accordance with the invention, a substantially constant pressure is maintained in the conduit 1 and the hose 7, that is, a substantially constant pressure is maintained in the gas feed line up to the upstream side of the dosing device 8. The particular pressure selected depends upon the filling pressure for the cylinder 13 or, in other words, the pressure which is to exist in the cylinder 13 when it is fully charged or filled to capacity with the gas to be confined therein. The pressure upstream of the dosing device 8 should be equal to at least the filling pressure for the cylinder 13 and, advantageously slightly exceeds this filling pressure.

The dosing device 8 regulates the flow rate of the gas into the cylinder 13 in dependence upon the conditions in the cylinder 13. Thus, as mentioned earlier, dissolution of the gas in the cylinder 13 is accompanied by the generation of heat. If the flow rate of the gas into the cylinder 13 is so great that this heat cannot be completely dissipated, a temperature increase will occur interiorly of the cylinder 13. Since the rate of dissolution of the gas is temperature dependent and, in particular, decreases with increasing temperature, the solvent in the cylinder 13 will be unable to absorb the gas at the rate at which it flows into the cylinder 13. Accordingly, an accumulation of the gas occurs and the pressure interiorly of the cylinder 13, that is, the pressure in the gas space above the solvent-gas interface, increases. This pressure increase is transmitted to the downstream side of the dosing device 8. Consequently, the pressure differential across the dosing device 8 or, in other words, the difference in pressure between the upstream and downstream sides of the dosing device 8, is reduced from what it was originally before the pressure increase in the cylinder 13 was created. As a result of this reduction in the pressure differential, the flow rate of the gas into the cylinder 13 is decreased. The flow rate of the gas into the cylinder 13 will then be adjusted to the instantaneous absorption capability of the solvent in the cylinder 13, that is, the flow rate of the gas into the cylinder 13 will be adjusted to the rate of dissolution of the gas.

Conversely, if the flow rate of the gas into the cylinder 13 is so low that gas is being dissolved or absorbed more rapidly than gas enters the cylinder 13, the pressure in the cylinder 13 will drop since gas is disappearing from the gas space interiorly of the cylinder 13 more rapidly than gas is entering this space. This pressure drop is transmitted to the downstream side of the dosing device 8 and the pressure differential across the dosing device 8 is thereby increased over the pressure differential existing prior to the pressure drop inside the cylinder 13. Accordingly, the flow rate of the gas into the cylinder 13 increases in response to the pressure drop therein. Again, the flow rate of the gas into the cylinder 13 will be adjusted to the instantaneous ability of the solvent in the latter to absorb the gas or, in other words, the flow rate of the gas into the cylinder 13 will be adjusted to the rate of dissolution of the gas.

When filling of the cylinder 13 nears completion, that is, when the capacity of the solvent in the cylinder 13 to absorb the gas is nearly exhausted, the rate of dissolution of the gas will decrease due to the accumulation of the gas in the gas space therein. In other words, gas is still flowing into the cylinder 13 at a rate greater than the ability of the nearly-exhausted solvent to absorb it. Again, the pressure differential across the dosing device 8 decreases and the flow rate of the gas into the cylinder 13 decreases therewith. When the filling operation is complete, that is, when the solvent in the cylinder 13 can no longer absorb any gas, the pressures in the cylinder 13 and the gas feed line upstream of the dosing device 8 are substantially equalized, i.e. the pressure differential between the upstream and downstream sides of the dosing device 8 drops to zero, and the flow of gas into the cylinder 13 is automatically stopped or at least reduced to a minimum value which avoids the danger of the cylinder 13 becoming overfilled.

The pressure in the gas feed line upstream of the dosing device 8 is maintained substantially constant regardless of the pressure variations downstream thereof and regardless of the variations in the rate of flow of the gas into the cylinder 13. Such a substantially constant pressure may be maintained by any conventional control means. For instance, the compressor 2 may be of the type which is steplessly variable so that the output thereof may be continuously and steplessly controlled in order to compensate for any influence which might affect the pressure in the gas feed line upstream of the dosing device 8.

The dosing device 8 according to the invention is provided with at least one passage for the flow therethrough of the gas. In this connection, it should be borne in mind that, generally, the quantity of gas flowing into a cylinder such as the cylinder 13 will depend not only on the difference in pressure between the gas feed line and the gas space inside the cylinder but also upon the size and type of the free flow cross-section provided for the gas flow into the cylinder. In accordance with the invention, the flow passage in the dosing device 8 has a definite cross-section which is preferably substantially constant.

Unless otherwise indicated, it will be understood herein that where reference is made to the dosing device having a flow passage of substantially constant cross-section this does not necessarily mean that the cross-section of the flow passage in the direction of gas flow is substantially constant but means that the cross-section of the flow passage is not varied during the filling process.

The dosing device 8 may serve several functions. Thus, as is clear from the preceding description, one important function of the dosing device 8 is to regulate the flow of gas into the cylinder in dependence upon the pressure differential between the upstream and downstream sides of the dosing device 8. In other words, the dosing device 8 regulates the flow of gas into the cylinder in dependence upon the difference in pressure between the gas feed line and the gas space interiorly of the cylinder, that is, in dependence upon the instantaneous ability of the solvent in the cylinder to absorb the gas. This ability may also vary due to different factors such as, for example, external cooling influences and changes in the ambient temperature. The dosing device 8 also regulates the flow of gas into the cylinder in dependence upon such factors. In addition to this, the dosing device 8 may serve a function in providing for an expansion of the gas which flows therethrough and is advantageously so designed that expansion of the gas occurs substantially adiabatically. As mentioned previously, an adiabatic expansion of the gas causes the gas to be cooled and this advantageously influences dissolution of the gas in the solvent since the rate of dissolution increases with decreasing temperature.

The dosing device 8 further serves to prevent a backward flow of the gas therethrough. Thus, since the pressure in the gas feed line is always at least equal to the pressure interiorly of the cylinder, a backward flow of the gas through the dosing device 8 is avoided or, put in another manner, since the dosing device 8 functions to create a positive (or zero) pressure differential across itself in downstream direction of the flow, it is not possible for upstream flow of the gas to occur. However, for safety purposes, conventional non-return valves, such as the valve 10 illustrated in FIG. 1, may also be provided.

For certain gases such as, for example, acetylene, it is important that the flow conditions be laminar. The reason is that for such gases the degree of safety is higher under conditions of laminar flow than under conditions of turbulent flow. The dosing device 8 may additionally serve for creating laminar flow conditions. Thus, if the passage in the dosing device 8 is of sufficiently small width or cross-section, the flow conditions for the gas may be laminar since the value of the Reynolds Number may be selected to be less than 2300. Laminar flow conditions may be obtained, for instance, by using sintered metal or capillary devices of other suitable materials with passages of very small cross-section.

In FIG. 1, an embodiment of the invention has been shown where the dosing device 8 regulates the flow into a single cylinder, namely, the cylinder 13. The cylinder 13 might be the only cylinder being filled or it might be of a group of cylinders being filled at the same time. However, the important point is that the dosing device 8 in FIG. 1 only regulates the flow of gas into a single cylinder, that is, the number of dosing devices for this embodiment is the same as the number of connections in the filling plant.

Figure 2:
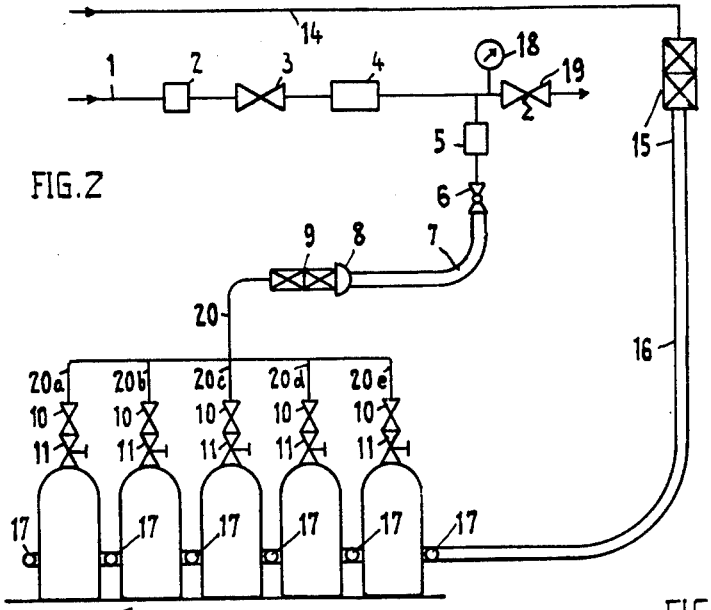
FIG. 2 is a somewhat diagrammatic representation of another form of an arrangement according to the invention which may be used for carrying out the method in accordance with the invention.

In contrast, FIG. 2 illustrates an embodiment of the invention where the dosing device 8 regulates the flow of gas into a group of cylinders. The components in FIG. 2 which are similar to those in FIG. 1 have been identified with the same reference numerals. For illustrative purposes, a group of five cylinders is shown as being filled simultaneously, this group of cylinders being generally identified with the reference numeral 12. It may be seen that the conduit 20 branches off into the five conduits 20*a*, 20*b*, 20*c*, 20*d* and 20*e* with each one of the latter leading to one of the group of cylinders 12.

The essential difference between FIGS. 1 and 2 resides in the fact that, in the latter Figure, the dosing device 8 simultaneously regulates the flow of gas into the five cylinders of the group 12 whereas, in FIG. 1, the dosing device 8 regulates the flow of gas only into the single cylinder 13.

The operating principles for the arrangement illustrated in FIG. 2 are similar to those outlined with reference to FIG. 1. The difference in operation resides in that, in FIG. 1, the dosing device 8 regulates the flow of gas in dependence upon the rate of dissolution or consumption of the gas in the cylinder 13 only. On the other hand, in FIG. 2, the dosing device 8 regulates the flow of gas in dependence upon the total consumption of gas in the five cylinders of the group 12. Thus, if the pressure in one of the cylinders of the group 12 increases while the pressure in the remaining cylinders remain constant, the flow rate of the gas into the group 12 of cylinders will decrease in such a manner that the increased pressure in the one cylinder compensates the remaining cylinders, which require the higher original flow rate, for the reduced flow rate. Conversely, if the pressure in one of the cylinders of the group 12 decreases while the pressures in the remaining cylinders remain constant, the flow rate of the gas into the group 12 of cylinders will increase in such a manner as to compensate the one cylinder for the decreased pressure therein while permitting the remaining cylinders, which require the lower original flow rate, to maintain their pressures. On the other hand, if the pressure in one of the cylinders of the group 12 increases while, simultaneously, the pressure in another one of the cylinders decreases correspondingly, with the pressures in the remaining cylinders being unchanged, no regulation of the gas flow by the dosing device 8 will occur since the cylinder with the increased pressure and the cylinder with the decreased pressure compensate one another. Similarly, if the pressure in one of the cylinders of the group 12 increases while, at the same time, the pressure in another one of the cylinders decreases but not by an amount corresponding to the pressure increase in the other cylinder, with the pressures in the remaining cylinders being unchanged, then the flow rate of the gas into the group 12 of cylinders will change in dependence upon the difference between the pressure increase and the pressure decrease.

It should be mentioned that the cylinders may be fixed or mounted in suitable carriages or the like for transportation in and around the plant and that they may remain in such conveyances during the filling operation. This eliminates the need for excessive lifting of the cylinders and contributes to the overall safety. Such conveyances may carry a large number of cylinders, for instance, 10 to 14. It is advantageous when the conveyance is built low to the ground so that the cylinders need not be lifted to be removed therefrom but may be rolled off the conveyance. The conveyances may be provided with a removable collector for the gas at the top thereof and with water nozzles at the bottom thereof. With this type of arrangement, the cylinders may be moved into position for filling and it is then merely necessary to connect two flexible hoses, namely, one for the gas such as the hose 7 in the Figures and one for the water or other cooling liquid such as the hose 16 in the Figures.

Figure 3:
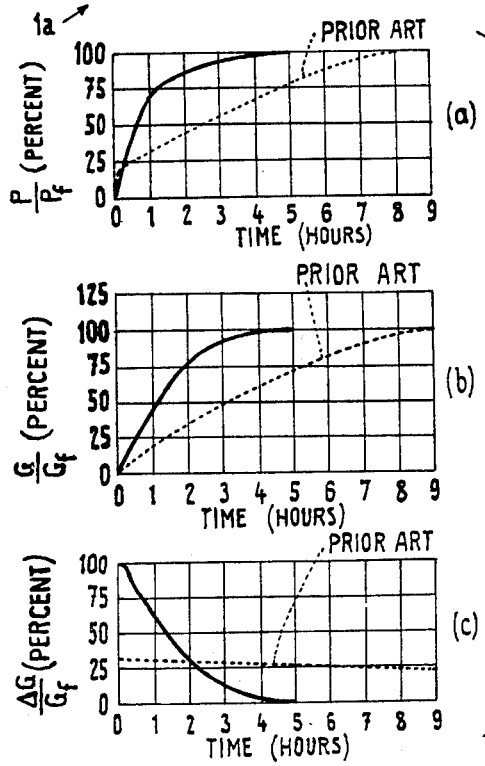
FIG. 3 is a comparison of filling parameters as obtained according to the prior art and as obtained according to the invention.

FIG. 3 compares different filling parameters for the filling method according to the invention with the prior art filling methods. These parameters are the pressure in the cylinder as a function of time, the weight of the cylinder as a function of time and the weight increase, that is, change in weight, of the cylinder as a function of time. This Figure relates to the filling of acetylene into cylinders. The cylinders have a volume of 28 liters and contain a porous mass consisting mainly of calcium silicates in the form of monolithic ceramic material of microporous structure and having a porosity of 90 to 92 percent. The solvent for the acetylene is acetone which is used in an amount of 310 grams per liter of cylinder volume. The quantity of acetylene charged into the cylinders is 190 grams per liter of cylinder volume. In FIG. 3, the solid curves represent the results obtained using the invention whereas the broken curves represent the results obtained using the prior art with water cooling.

FIG. 3*a* shows the pressure in the cylinder during filling as a function of time. The pressure in the cylinder is represented in terms of the ratio of the instantaneous pressure P to the final pressure $P_f$ in the cylinder multiplied by 100, namely, in percent. In a conventional filling plant, the pressure increases nearly linearly as indicated by the broken curve. The reason is that a definite number of cylinders is connected to the gas line of one compressor, or of one compressor group, which starts to run when all of the cylinders have been connected. The pressure progressively increases from zero to the filling pressure, which latter corresponds to the maximum permissible filling pressure for acetylene cylinders at the particular temperature.

FIG. 3*b* shows the weight of the cylinder during filling as a function of time. The weight of the cylinder is represented in terms of the ratio of the instantaneous weight G to the final allowable weight $G_f$ of the cylinder multiplied by 100, namely, in percent.

FIG. 3*c* shows the weight increase of the cylinder during filling as a function of time. This is represented in terms of the ratio of the instantaneous weight increase $\Delta G$ to the final allowable weight $G_f$ of the cylinder multiplied by 100, namely, in percent.

The broken curves in FIGS. 3*a* and 3*b* illustrate the situation in conventional filling plants. Since the capacity of the compressor or compressor group is constant, the weight of the cylinder increases substantially linearly during filling, similarly to the pressure subsequent to its short, relatively rapid initial increase. On the other hand, for the same reason, the weight increase or change in weight of the cylinder during filling remains substantially constant.

When using the conventional filling system, only half of the filling room is usually occupied by cylinders being charged. The other half of the filling room is occupied by filled cylinders which are being disconnected or by empty cylinders which are being connected. In other words, since it is not possible to disconnect a filled cylinder from a given connecting rack while the remaining cylinders connected to the same rack are still being charged, and since, likewise, it is not possible to connect an empty cylinder to a given connecting rack while other cylinders connected to this rack are being filled, only half of the available connections can be used simultaneously. This makes for an irrational use of the available surface area in the filling room since half of this surface area is non-productive at any given time. This situation might be improved by working with several compressors. Theoretically, for instance, by utilizing three compressors and four connecting racks, it becomes possible to use three-quarters of the connection or surface area. However, this is associated with the disadvantage that the rack systems and the controls are more complicated.

Therefore, one of the objectives of the invention is to provide a system whereby the maximum number of connections may be used simultaneously without, however, requiring excessively complicated rack systems and controls. In accordance with the invention, this is achieved by working with a substantially constant pressure during filling and by designing the rack (or manifold) system in the manner illustrated in FIGS. 1 and 2. The effect of the invention may be seen from FIG. 3. As indicated by the solid curves in FIGS. 3*a* and 3*b*, both the pressure inside the cylinder and the weight of the cylinder increase much more rapidly at the beginning of the filling process than is the case with the prior art system. Moreover, as indicated by the solid curve in FIG. 3*c*, the change in weight of the cylinder as a function of time when proceeding in accordance with the invention is completely different from that when using conventional filling methods. This curve shows that the change in weight is high at the start of the filling operation and decreases subsequently as the weight of the cylinder increases.

The curves of FIG. 3 also indicate that another essential feature of the system according to the invention, which may be termed the "constant pressure filling system", is the shorter filling time as compared with the filling time in conventional plants, with or without water cooling. This is due to the fact that the substantially constant pressure of the gas in the filling rack (or manifold) is preferably greater than the filling pressure, that is, the final pressure in the fully charged cylinder, and the fact that a definite quantity of gas, which is a function of the pressure inside the cylinder, is expanded and cools itself in the dosing device according to the invention which was developed and designed for that purpose. Also, the gas is dissolved, for example, in acetone, at a lower temperature and, consequently, the rate of absorption of acetylene is optimal. For the case illustrated in FIG. 3, the filling time is four hours when using the invention but this is dependent upon the type of cylinders used and may be reduced by working with a higher line pressure or by using a dosing device with a larger flow cross-section.

Figure 2A:
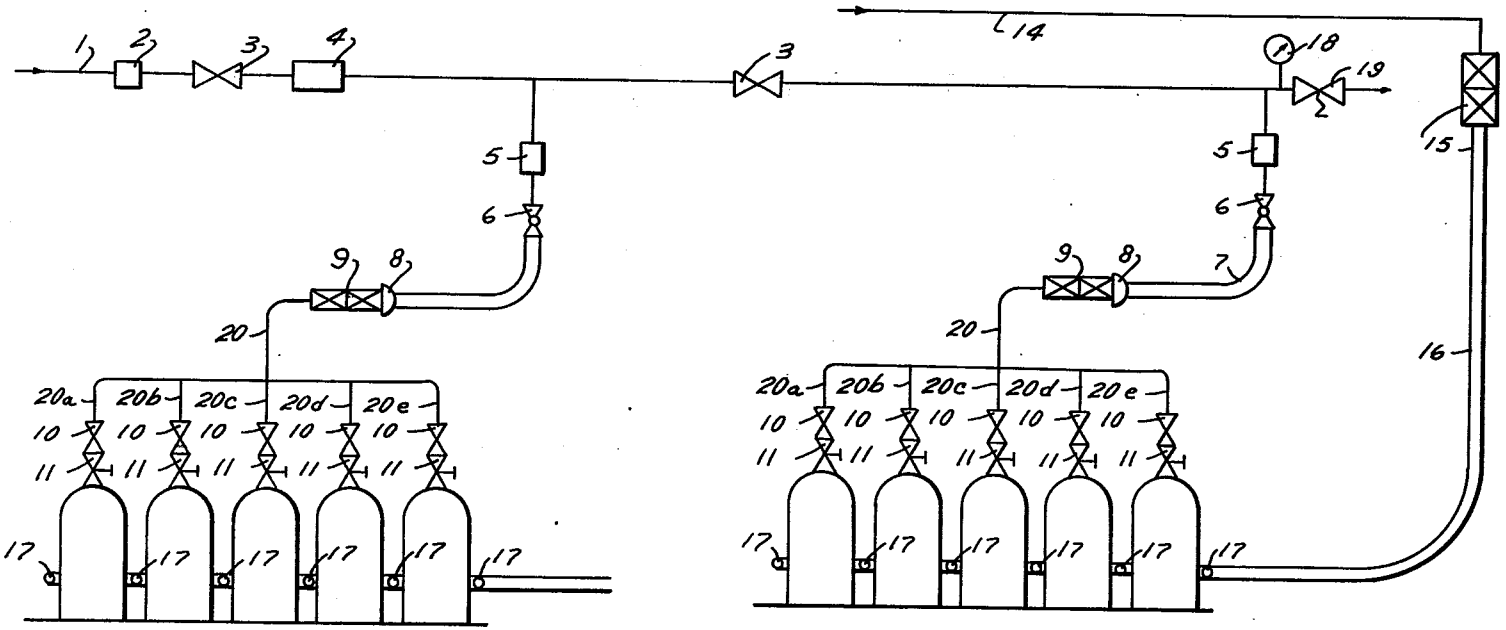
FIG. 2*a* depicts a set-up such as shown in FIG. 2, but for the filling of two groups of cylinders.

Thus, as will be clear from FIG. 2*a*, because the gas feed line pressure is maintained constant, one of the two groups of cylinders can be connected to the feed line and their filling commenced, without having first to wait for the filling of the other group of cylinders to be completed.

Figure 4:
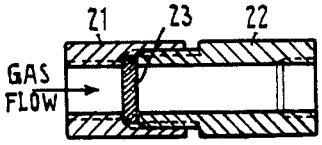
FIG. 4 to 6 are longitudinal sections through three embodiments of devices according to the invention which may be used for dosing gas flow.

Referring now to FIG. 4, it may be seen that this illustrates one form of a dosing device according to the invention. The dosing device comprises two tubular members 21 and 22 which are provided with mating threads for engagement to one another so as to define together a flow passage for a gas. A disc 23 of sintered material having a substantially cylindrical configuration extends across the flow passage defined by the members 21 and 22 and is held in position by the latter two members. The disc 23 defines a multitude of capillary passages and is effective for dosing or regulating the flow of gas through the passage defined by the members 21 and 22. It will be appreciated that the material constituting the disc 23 should be chemically resistant to the gas flowing therethrough.

Figure 5:
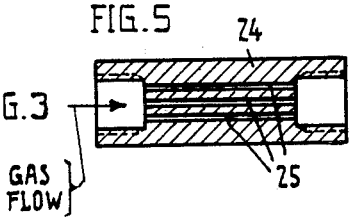

FIG. 5 shows another form of a dosing device in accordance with the invention. Here, the dosing device comprises a cylindrical member 24 which is provided with a plurality of relatively long capillary passages 25 extending longitudinally thereof. The passages 25 serve to dose the flow of gas through the member 24 and, in the illustrated embodiment, the diameter and length of each passage 25 is selected in such a manner that the Reynolds Number for the gas flow is less than about 2300.

Figure 6:
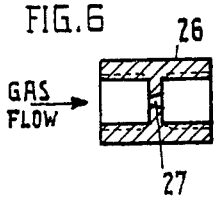

Still another form of a dosing device according to the invention is illustrated in FIG. 6. The embodiment of the dosing device shown here includes a tubular member 26 provided with a calibrated orifice 27 for dosing the gas flow. Preferably, the orifice 27 flares conically outwardly in the direction of gas flow as indicated. The gas flow through the orifice 27 may be turbulent or laminar depending upon the dimension of the smallest diameter thereof.

It will be appreciated that the system in accordance with the invention is a practical one since cylinders may be connected and begun to be filled at any time. Moreover, this system is an economical one since a very great percentage of the connections may be used simultaneously. The investment for the filling racks and their fittings is thus minimal and the same applies to the filling room which may have a smaller surface area than required heretofore. The system according to the invention is also a safe one, guaranteeing a very high degree of safety because the absorption capacity of each cylinder is automatically adapted to the pressure and the temperature inside the cylinder at a definite time and because the gas flow may be laminar in the dosing device.

Some of the important features of the invention and some of the important advantages thereof may be summarized as follows: By regulating the output of the compressor or compressors, a substantially constant pressure $P_1$ is maintained in the gas distribution network. In each branch of the network which conveys gas from the distribution network to an individual gas container or to a group of gas containers, there is provided a dosing device which throttles the gas flowing therethrough from the pressure $P_1$ to an individual pressure $P_2$. The dosing device, which may, for example, comprise a sintered metallic body, a capillary device, an orifice plate, a nozzle or a valve, makes the quantity of gas flowing therethrough directly dependent upon the pressure difference $\Delta P = P_1 - P_2$. The quantity of gas flowing through the dosing device decreases with decreasing pressure difference and vice versa.

As a result of this characteristic, the dosing device automatically adjusts the quantity of gas conveyed to each individual container or container group to a value which corresponds to the maximum capability of each container or container group to further dissolve gas under the instantaneously existing conditions and the controlling characteristics of the containers.

If the quantity of gas being introduced exceeds the absorption ability of the solvent, the pressure $P_2$ existing in the container increases. The pressure differential $\Delta P$ at the dosing device gradually decreases whereby the quantity of gas flowing therethrough is reduced. Conversely, if the quantity of gas being introduced is too small in relation to the absorption capability of the solvent, then the pressure $P_2$ in the container decreases and the pressure difference increases whereby the quantity of gas being introduced also increases. In this manner, each discrepancy between the quantity of gas being introduced and the absorption ability of the solvent is immediately compensated for so that there is always just so much gas being conveyed to the container or container group as can be taken up by the solvent.

In connection with the described method, the output of the compressor or compressor group may be steplessly regulated within certain limits. Thus, in accordance with the filling system of the invention, the gas is compressed at a substantially constant pressure which is preferably slightly greater than the filling pressure. One manner of maintaining a substantially constant pressure in the filling racks (manifolds) is by regulating the output volume and, hence, the speed, of the compressor by means of a pressure transmitter (as shown at PT in FIG. 1). In this manner, the compressor output may be automatically and immediately adapted to the demand of gas for the cylinders being filled.

The acceleration of the filling process achieved by using the invention is based on two different factors:

In the first place, pressure characteristics are created in the gas container on the side of the gas phase therein which take into account the instantaneous absorption capability of the solvent in the sense that the absorption of maximum quantities of gas is made possible while taking into consideration the instantaneous effects of the most diverse influencing factors such as the temperature of the gas and of the solvent, the concentration already achieved in the solution formed by dissolution of the gas in the solvent, etc. By proceeding according to the invention, the instantaneous absorption ability of the solvent is being constantly fully utilized which, particularly in the initial time period of the filling operation, results in a substantial acceleration and has the consequence that the total time period for the filling operation is greatly reduced. This is not the case with the conventional filling processes since the pressure over the solvent or solution is unilaterally determined by the particular, constant output of the compressor group and by the relationship thereof to the number and to the characteristics of the connected gas containers.

In the second place, a cooling of the gas occurs during the throttling in the dosing device. This cooling effect is, according to the invention, based on the Joule-Thomson effect which relates to the results obtained when a fluid is permitted to flow through a restriction from a higher to a lower pressure. Throttling involves the flow of a fluid through a restriction from a higher to a lower pressure in such a manner that the enthalpies immediately upstream and immediately downstream of the restriction are the same.

It is an experimental fact that throttling of a fluid may result in a final temperature which is higher or lower than the initial value, that is, the value prior to throttling. Whether the temperature during throttling increases, decreases or remains the same depends upon the values of the temperature and pressure upstream of the dosing or throttling device as well as the pressure downstream of the dosing or throttling device.

The Joule-Thomson coefficient provides a mathematical measure of the effect of throttling a fluid. This coefficient is defined as follows:

$$\text{Joule-Thomson Coefficient} = \mu_{JT} = \left(\frac{\delta T}{\delta P}\right)_h$$

The Joule-Thomson coefficient may be determined for a given state by plotting experimental data on a diagram of temperature versus pressure in terms of a family of constant-enthalpy lines. Such lines may be obtained by holding the temperature and pressure upstream of a throttling device constant, varying the pressure downstream of the throttling device and measuring the temperature which corresponds to each value of the pressure downstream of the throttling device. Under throttling conditions, the enthalpy downstream of the throttling device will be the same as that upstream of the throttling device for each measurement made. When a sufficient number of measurements has been made a plot a constant-enthalpy line, either the temperature or pressure upstream of the throttling device is changed and the process is repeated to obtain yet another set of measurements corresponding to a second constant-enthalpy line having an enthalpy value different from the first line. The slope of a constantenthalpy line at any state, that is, at any point on the temperature versus pressure diagram, is a measure of the Joule-Thomson coefficient at that state.

When a number of appropriate constant-enthalpy lines are plotted on a temperature versus pressure diagram, it is found that each constant-enthalpy line passes through a point of maximum temperature, that is, a point such that the temperature decreases with both increasing and decreasing pressure upon moving away from this point along the constant-enthalpy line. A line which passes through these points of maximum temperature may be drawn and this line is known as the inversion line. The maximum temperatures of the constant-enthalpy lines are correspondingly known as the inversion temperatures.

The inversion line has an important physical significance. Assuming the temperature versus pressure diagram to be oriented such that temperature is the ordinate and pressure is the abscissa, the Joule-Thomson coefficient is negative to the right of the inversion line. In other words, in the region of the temperature versus pressure diagram to the right of the inversion line, the temperature will increase as pressure decreases through the throttling device and a heating effect occurs for expansions in this region. On the other hand, the Joule-Thomson coefficient is positive to the left of the inversion curve which means that, in the region of the temperature versus pressure diagram to the left of the inversion line, the temperature will decrease as the pressure decreases through the throttling device. Accordingly, a cooling effect occurs for expansions in the latter region. It follows that, for throttling of a fluid, the temperature downstream of the throttling device may be greater than, equal to or less than the temperature upstream of the throttling device depending upon the pressure downstream of the throttling device for any given set of conditions upstream of the latter.

A process in accordance with the invention is carried out in such a manner that, overall, the Joule-Thomson coefficient is not negative during the filling of a container. Thus, during at least a portion of the time that a container is being filled with gas, the temperature and pressure conditions are such that the decrease of pressure which occurs when the gas passes through the dosing or throttling device is accompanied by a decrease in temperature. It will be appreciated that, on the one hand, account must be taken of the temperature of the surroundings and, on the other hand, each gas has a characteristic Joule-Thomson coefficient which varies with the temperature and pressure conditions.

According to one embodiment of the invention, the temperature and pressure conditions may be selected in such a manner that the Joule-Thomson coefficient is positive during the entire period that a container is being filled with gas.

According to another embodiment of the invention the filling of a container may be begun under temperature and pressure conditions such that the Joule-Thomson coefficient is negative while the filling of the container is completed under temperature and pressure conditions such that the Joule-Thomson coefficient is positive. In this embodiment of the invention, the magnitude of the initial, negative Jourle-Thomson coefficient should be sufficiently small that the temperature rise due to the occurrence of a negative Joule-Thomson coefficient is at least compensated by the temperature decrease which occurs subsequently during expansion of the gas under temperature and pressure conditions such that the Joule-Thomson coefficient is positive. Favorably, the overall effect of the expansion of the gas is a temperature decrease of the gas.

Quantitavely, the cooling obtained by the Joule-Thomson effect may be only a fraction of that required to compensate for the heat generated by dissolution of the gas. However, since the cooling effect is conveyed by the gas directly to the interface between the gas phase and the solvent or solution, which is where absorption of the gas effectively occurs, this interface experiences an effective cooling, particularly during the first stages of the filling of the gas if the Joule-Thomson coefficient is initially positive. In contrast, with the filling processes conventionally utilized heretofore, the interface is the warmest part of the solvent or solution and this has the result of significantly drawing out or lengthening the dissolution process. By virtue of the earlier-mentioned cooling of the interface obtained according to the invention, this hitherto existing disadvantage may be more than merely avoided.

By utilizing the invention, not only is there obtained as a significant advantage a shortening of the filling time, but the following advantages are also achieved:

By the selection and dimensioning of the dosing device for an individual gas container, or for container groups in which gas containers having similar filling characteristics are connected together, it becomes possible to take better account of the corresponding filling characteristics than with the conventional filling processes.

There also exists the possibility of connecting gas containers to be filled, either individually or in container groups, to the gas distribution network at any time without thereby disturbing the filling process of containers which are already connected. Consequently, the procedure for the preparation of the containers for filling, that is, weighing of the containers, filling of the containers with solvent, etc., is made more flexible and may be arranged in a more rational manner than heretofore. In contrast, with the prior art filling processes, which operate with sections of predetermined size and with a predetermined amount of space relegated for filling, it is always necessary to maintain a specified number of containers in readiness for connection to the distribution network for a certain time interval starting at a fixed time.

Moreover, since, by using the invention, filling may begin immediately after connection of the containers to the gas distribution network, that is, it is no longer necessary to wait until a filling rack is fully occupied before starting the filling operation, and since also the time required for the filling is shorter than heretofore, it is possible for an arrangement using the invention to be provided with fewer connections to the gas distribution network than an arrangement having the same capacity but operated in accordance with the prior art. Correspondingly, an arrangement using the invention requires less room than one using the prior art.

It will be appreciated that the invention is applicable to gases other than acetylene. Thus, the invention may be used for any and all gaseous substances which are confined in an at least partially dissolved state such as, for instance, carbon dioxide ($CO_2$) which is soluble in water; ethylene oxide ($C_2H_4O$) which is soluble in water; ethylene ($C_2H_6$) which is soluble in dimethylformamide (DMF); and ammonia ($NH_3$) which is soluble in water.

It will be understood that each of the elements described above, or two or more together, may also find a useful application in other types of methods and arrangements differing from the types described above.

While the invention has been illustrated and described as embodied in a process and arrangement for filling gas cylinders, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt if for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended:

1. An improved method of filling a vessel with compressed gas, the method being of the type wherein the inlet of a vessel to be filled with compressed gas is connected to a compressed-gas feed line to form a gas feed path leading into the interior of the vessel, to thereby feed gas into the vessel causing the weight and pressure of gas within the vessel to rise until the vessel has been filled, the improvement comprising (a) connecting the inlet of the vessel to the gas feed line through the intermediary of a flow restrictor, the flow restrictor having a flow cross-section which is smaller than the flow cross-section of the gas feed path upstream of the flow restrictor;

(b) filling the vessel with compressed gas by forcing compressed gas through the gas feed line and through the flow restrictor into the interior of the vessel, whereby the weight and pressure of compressed gas in the vessel increase during the course of the filling operation;

(c) during the entirety of the filling operation using pressure regulation to keep constant with respect to time the gas pressure in the part of the gas feed path upstream of the flow restrictor, including the gas feed line and all the way through and to the point in the gas feed path immediately upstream of the flow restrictor; and (d) during the entirety of the filling operation keeping the gas feed path, including the constant-pressure gas feed line and going all the way through the flow restrictor into the interior of the vessel, unblocked for gas flow in the direction into the vessel, whereby compressed gas passes from the constant-pressure gas feed line through the flow restrictor and into the vessel so long as the gas pressure downstream of the flow restrictor is lower by at least a predetermined amount than the pressure upstream of the flow restrictor.

2. A method as defined in claim 1 the gas feed line extending from the outlet of a compressor which forces compressed gas through the gas feed line, the pressure regulation comprising using a pressure transmitter to sense the gas pressure in the constant-pressure gas feed line and in dependence upon the sensed pressure automatically adjusting the compressor in order to keep constant the gas pressure in said constant-pressure part of the gas feed path.

3. A method as defined in claim 2, the method being of the type wherein a plurality of vessels are filled from a common gas feed line through which compressed gas is forced, the method furthermore comprising connecting the inlets of a first group of vessels to be filled to the common gas feed line and performing a filling operation in accordance with said steps (a) through (d), connecting the inlets of a second group of vessels to be filled to the common gas feed line and performing a filling operation in accordance with said steps (a) through (d), not waiting for the filling of the first group of vessels to be completed, but instead connecting the inlets of the second group of vessels to the common gas feed line in the middle of the filling operation for the first group of vessels and starting the filling of the second group of vessels in the middle of the filling operation for the first group of vessels, whereby the fact that the gas pressure in the common gas feed line is constant during the filling of vessels makes it possible to connect the second group of vessels to the common gas feed line in the middle of the filling operation for the first group of vessels and then start the filling of the second group of vessels without having to wait for the filling of the first group of vessels to be completed.

4. A method as defined in claim 3, the method furthermore comprising using for the vessels to be filled vessels containing a liquid solvent for the compressed gas with which the vessels are to be filled.

5. A method as defined in claim 2, the method furthermore comprising using for the vessel to be filled a vessel containing a liquid solvent for the compressed gas with which the vessels are to be filled.

6. A method as defined in claim 1, the method furthermore comprising using for the vessel to be filled a vessel containing a liquid solvent for the compressed gas with which the vessel is to be filled.

7. An arrangement for filling a vessel with compressed gas, the arrangement comprising a gas feed line through which compressed gas is to be forced;

means operative for forcing compressed gas into and through the gas feed line;

connecting means having an upstream end connected to and communicating with the interior of the gas feed line and having a downstream end connectable to the inlet of a vessel to be filled with compressed gas in order to form a gas feed path extending through the gas feed line and the connecting means into the interior of the vessel to be filled, the connecting means including a flow restrictor having a flow cross-section which is smaller than the flow cross-section of the gas feed path upstream of the flow restrictor, the gas feed path, including the gas feed line and going all the way through the flow restrictor to and through the downstream end of the connecting means, being unblocked for gas flow in the direction into the vessel; and pressure regulating means operative during the entirety of a filling operation for keeping constant with respect to time the gas pressure in the part of the gas feed path upstream of the flow restrictor, including the gas feed line and all the way through and to the point in the gas feed line immediately upstream of the flow restrictor.

8. The arrangement defined in claim 7, the means for forcing compressed gas into and through the gas feed line comprising a compressor, the pressure regulating means comprising a pressure transmitter operative for sensing the gas pressure in the constant-pressure part of the gas feed path and in dependence upon the sensed pressure automatically adjusting the compressor to keep constant the gas pressure in the constant-pressure part of the gas feed path.

9. The arrangement defined in claim 7, the connecting means being a first connecting means for connecting at least one first vessel to the gas feed line, the arrangement furthermore including a second connecting means, of the same construction as the first connecting means, for connecting at least one second vessel to the gas feed line, the gas feed line accordingly serving as a common gas feed line for first and second vessels to be filled, the pressure regulating means comprising means operative during the entirety of a filling operation performed using the first connecting means for keeping constant with respect to time the gas pressure in the part of the gas feed path upstream of the flow restrictor of the first connecting means and also in the part of the gas feed path upstream of the flow restrictor of the second connecting means, whereby a second vessel connected to the common gas feed line by the second connecting means can begin to be filled from the constant-pressure gas feed line without having to wait for the completion of the filling of a first vessel already connected to and being filled through the first connecting means.

10. The arrangement defined in claim 7, the flow restrictor comprising a sintered metallic body.

11. The arrangement defined in claim 7, the flow restrictor comprising a capillary device.

12. The arrangement defined in claim 7, the flow restrictor comprising an orifice plate.

13. The arrangement defined in claim 7, the flow restrictor comprising a nozzle.

14. The arrangement defined in claim 7, the flow restrictor comprising a flow-restricting valve.

15. The arrangement defined in claim 7, wherein the flow restrictor is effective for causing substantially laminar flow of the gas at Reynolds Numbers below about 2300.

* * * * *